US008410884B2

(12) United States Patent
Hughes et al.

(10) Patent No.: US 8,410,884 B2
(45) Date of Patent: Apr. 2, 2013

(54) COMPACT HIGH SHORT CIRCUIT CURRENT REACTOR

(75) Inventors: Christian T. Hughes, Hillsborough, NJ (US); Peter Thomas Bircsak, Asbury, NJ (US)

(73) Assignee: Hitran Corporation, Flemington, NJ (US)

( * ) Notice: Subject to any disclaimer, the term of this patent is extended or adjusted under 35 U.S.C. 154(b) by 0 days.

(21) Appl. No.: 13/317,521

(22) Filed: Oct. 20, 2011

(65) Prior Publication Data

US 2012/0188048 A1 Jul. 26, 2012

Related U.S. Application Data

(60) Provisional application No. 61/461,637, filed on Jan. 20, 2011.

(51) Int. Cl.

| | |
|---|---|
| ***H01F 17/06*** | (2006.01) |
| ***H01F 27/28*** | (2006.01) |
| ***H01F 27/26*** | (2006.01) |
| ***H01F 27/24*** | (2006.01) |

(52) U.S. Cl. ..... 336/178; 336/170; 336/210; 336/212; 336/216

(58) Field of Classification Search ..... 336/160, 336/165, 170, 178, 210, 212–216, 221, 234
See application file for complete search history.

(56) References Cited

U.S. PATENT DOCUMENTS

| | | | | |
|---|---|---|---|---|
| 2,664,541 | A * | 12/1953 | Henderson | 315/239 |
| 2,668,250 | A * | 2/1954 | Henderson | 336/170 |
| 2,909,742 | A * | 10/1959 | Lamberton | 336/212 |
| 2,965,865 | A | 12/1960 | Zack | |
| 3,096,568 | A | 7/1963 | Biggs et al. | |
| 3,428,930 | A | 2/1969 | Sliepenbeek | |
| 3,636,488 | A | 1/1972 | Wiesner | |
| 3,691,492 | A * | 9/1972 | Muller | 336/60 |
| 4,238,879 | A | 12/1980 | Zurlinden, III et al. | |
| 5,367,912 | A | 11/1994 | Demachi | |
| 5,530,415 | A | 6/1996 | Takaya et al. | |
| 6,162,311 | A | 12/2000 | Gordon et al. | |
| 6,198,374 | B1 | 3/2001 | Abel | |
| 6,204,744 | B1 | 3/2001 | Shafer et al. | |
| 6,345,434 | B1 | 2/2002 | Anbo et al. | |
| 6,420,953 | B1 | 7/2002 | Dadafshar | |
| 6,429,765 | B1 | 8/2002 | Valdemarsson et al. | |
| 6,449,829 | B1 | 9/2002 | Shafer | |
| 6,480,086 | B1 | 11/2002 | Kluge et al. | |
| 6,559,751 | B2 | 5/2003 | Liu et al. | |
| 6,653,923 | B2 | 11/2003 | Li et al. | |
| 6,658,724 | B2 | 12/2003 | Nakano et al. | |
| 6,683,524 | B1 | 1/2004 | Höglund | |
| 6,720,074 | B2 | 4/2004 | Zhang et al. | |
| 6,808,642 | B2 | 10/2004 | Takaya et al. | |
| 6,817,085 | B2 | 11/2004 | Uchikoba et al. | |
| 6,819,214 | B2 | 11/2004 | Elliott et al. | |
| 6,949,237 | B2 | 9/2005 | Smalley et al. | |
| 6,952,355 | B2 | 10/2005 | Riggio et al. | |

(Continued)

*Primary Examiner* — Mohamad Musleh
*Assistant Examiner* — Mangtin Lian
(74) *Attorney, Agent, or Firm* — Sperry, Zoda & Kane

(57) ABSTRACT

A three phase compact high short circuit current reactor also commonly known as an inductor is disclosed which can be easily be modified during initial construction to provide predefined gaps between the internal core sections for enhancing performance for each individual customized application. Inductor core sections are commonly oriented horizontally. The present design provides a core construction which includes multiple vertically stacked coils with yokes positioned between adjacent coils for facilitating flux cancellation to enhance performance. The coils can be round or square in cross-section and normally are made of either wire or foil usually of copper or aluminum. The material of the core is preferably of a silicon steel material which can be grain-oriented or non-grain-oriented.

20 Claims, 5 Drawing Sheets

U.S. PATENT DOCUMENTS

| | | | |
|---|---|---|---|
| 6,971,391 | B1 | 12/2005 | Wang et al. |
| 6,979,709 | B2 | 12/2005 | Smalley et al. |
| 7,034,091 | B2 | 4/2006 | Schultz et al. |
| 7,069,639 | B2 | 7/2006 | Choi et al. |
| 7,091,412 | B2 | 8/2006 | Wang et al. |
| 7,140,092 | B2 | 11/2006 | Park et al. |
| 7,262,482 | B2 | 8/2007 | Ahn et al. |
| 7,262,680 | B2 | 8/2007 | Wang |
| 7,277,000 | B2 | 10/2007 | Suzui et al. |
| 7,294,366 | B2 | 11/2007 | Renn et al. |
| 7,319,599 | B2 | 1/2008 | Hirano et al. |
| 7,330,369 | B2 | 2/2008 | Tran |
| 7,375,417 | B2 | 5/2008 | Tran |
| 7,380,328 | B2 | 6/2008 | Ahn et al. |
| 7,390,477 | B2 | 6/2008 | Smalley et al. |
| 7,400,512 | B2 | 7/2008 | Hirano et al. |
| 7,419,624 | B1 | 9/2008 | Smalley et al. |
| 7,420,452 | B1 | 9/2008 | Lee et al. |
| 7,481,989 | B2 | 1/2009 | Smalley et al. |
| 7,485,366 | B2 | 2/2009 | Ma et al. |
| 7,489,537 | B2 | 2/2009 | Tran |
| 7,567,163 | B2 | 7/2009 | Dadafshar et al. |
| 7,791,445 | B2 | 9/2010 | Manoukian et al. |

* cited by examiner

COMPACT HIGH SHORT CIRCUIT CURRENT REACTOR

The present utility application hereby formally claims priority of currently pending United States Provisional Patent application No. 61/461,637 filed Jan. 20, 2011 on "COMPACT HIGH SHORT CIRCUIT CURRENT REACTOR" filed by the same inventor listed herein, namely, Christian T. Hughes of Hillsborough, N.J. and Peter Thomas Bircsak of Asbury, N.J. and assigned to Hitran Corporation of Flemington, N.J., and said referenced provisional application is hereby formally incorporated by reference as an integral part of the present application.

BACKGROUND OF THE INVENTION

1. Field of the Invention

The present invention provides a unique configuration for facilitating the construction of compact three phase line reactors or inductors in order to provide high short circuit capability within relatively compact spaces. This design in this manner provides a compact design for high short circuit requirements of approximately 15-25× rated current and can be used in many difference applications.

2. Description of the Prior Art

Examples of various types of stacked reactors with unique core structures are shown in many current and expired United States patents such as shown in U.S. Pat. No. 2,965,865 patented Dec. 20, 1960 to A. Zack and assigned to Sylvania Electric Products, Inc. of Wilmington, Del. on an "Electrical Conductor"; and U.S. Pat. No. 3,096,568 patented Jul. 9, 1963 to O. H. Biggs et al and assigned to Sylvania Electric Products Inc. on "Manufacture Of Laminated Core Inductors"; and U.S. Pat. No. 3,428,930 patented Feb. 18, 1969 to A. H. TH. J. Sliepenbeek and assigned to Smit Nijmegen Electrotechnische Fabrieken N. V., of Nijmegen, Netherlands on "Laminated Magnetic Core Structures For Transformers Or Choke Coils Of Great Power"; and U.S. Pat. No. 3,636,488 patented Jan. 18, 1972 to Ernst Wiesner and assigned to Dr. Walter Zumtobel of Dombim, Austria on a "Transformer Or Inductor Assembly"; and U.S. Pat. No. 4,238,879 patented Dec. 16, 1980 to C. P. Zurlinden, III et al on a "Laminated Inductor Stacking And Calibrating Apparatus"; and U.S. Pat. No. 5,367,912 patented Nov. 29, 1994 to Takashi Demachi and assigned to Toa Medical Electronics Co., Ltd., of Kobe, Japan on an "Apparatus For Analyzing Liquid Specimen"; and U.S. Pat. No. 5,530,415 patented Jun. 25, 1996 to Minoru Takaya et al and assigned to TDK Corporation of Tokyo, Japan on "Composite Winding Type Stacked-Layer Inductors Including Self Inductive Inductors And Manual-Inductive Inductors"; and U.S. Pat. No. 6,162,311 patented Dec. 19, 2000 to S. Gordon et al and assigned to MMG of North America, Inc. on "Composite Magnetic Ceramic Toroids"; and U.S. Pat. No. 61,198,374 patented Mar. 6, 2001 to D. A. Abel and assigned to Midcom, Inc. on a "Multi-Layer Transformer Apparatus And Method"; and U.S. Pat. No. 6,204,744 patented Mar. 20, 2001 to T. M. Shafer et al and assigned to Vishay Dale Electronics, Inc. on a "High Current, Low Profile Inductor"; and U.S. Pat. No. 6,345,434 patented Feb. 12, 2002 to Toshiyuki Anbo et al and assigned to TDK Corporation of Tokyo, Japan on a "Process Of Manufacturing An Inductor Device With Stacked Coil Pattern Units"; and U.S. Pat. No. 6,420,953 patented Jul. 16, 2002 to M. Dadafshar and assigned to Pulse Engineering, Inc. on a "Multi-Layer, Multi-Functioning Printed Circuit Board"; and U.S. Pat. No. 6,429,765 patented Aug. 6, 2002 to Stefan Valdemarsson et al and assigned to ABB AB of Vasteras (SE) on a "Controllable Inductor"; and U.S. Pat. No. 6,480,086 patented Nov. 12, 2002 to Wolfram Kluge et al and assigned to Advanced Micro Devices, Inc. of Austin, Tex. on an "Inductor And Transformer Formed With Multi-Layer Coil Turns Fabricated On An Integrated Circuit Substrate"; and U.S. Pat. No. 6,559,751 patented May 6, 2003 to Shen-Iuan Liu et al and assigned to Archic Tech. Corp. of Taipei (TW) on an "Inductor Device"; and U.S. Pat. No. 6,653,923 patented Nov. 25, 2003 to Y. Li et al and assigned to Cooper Technologies Company on an "Inductor Manufacture And Method"; and U.S. Pat. No. 6,658,724 patented Dec. 9, 2003 to A. Nakano et al and assigned to TDK Corporation on "Powder For Magnetic Ferrite, Magnetic Ferrite, Multilayer Ferrite Components And Production Method Thereof"; and U.S. Pat. No. 6,683,524 patented Jan. 27, 2004 to Lennart Hoglund on a "Transformer Core"; and U.S. Pat. No. 6,720,074 patented Apr. 13, 2004 to Y. Zhang et al and assigned to Inframat Corporation on "Insulator Coated Magnetic Nanoparticulate Composites With Reduced Core Loss And Method Of Manufacture Thereof"; and U.S. Pat. No. 6,808,642 patented Oct. 26, 2004 to M. Takaya et al and assigned to TDK Corporation on a "Method For Producing Multilayer Substrate And Electronic Part, And Multilayer Electronic Part"; and U.S. Pat. No. 6,817,085 patented Nov. 16, 2004 to F. Uchikoba et al and assigned to TDK Corporation on a "Method Of Manufacturing A Multilayer Ferrite Chip Inductor Array"; and U.S. Pat. No. 6,819,214 patented Nov. 16, 2004 to B. Elliott et al and assigned to Cooper Technologies Company on a "Component Core. With Coil Terminations"; and U.S. Pat. No. 6,949,237 patented Sep. 27, 2005 to R. E. Smalley et al and assigned to William Marsh Rice University on a "Method For Growing Single-Wall Carbon Nanotubes Utilizing See3d Molecules"; and U.S. Pat. No. 6,952,355 patented Oct. 4, 2005 to C. A. Riggio et al and assigned to OPS Power LLC ON A "Two-Stage Converter Using Low Permeability Magnetics"; and U.S. Pat. No. 6,971,391 patented Dec. 6, 2005 to X. Wang et al and assigned to Nanoset, LLC on a "Protective Assembly"; and U.S. Pat. No. 6,979,709 patented Dec. 27, 2005 to R. E. Smalley et al and assigned to William March Rice University on a "Continuous Fiber Of Single-Wall Carbon Nanotubes"; and U.S. Pat. No. 7,034,091 patented Apr. 25, 2006 to P. G. Schultz et al and assigned to The Regents of the University of California and Symyx Technologies, Inc.; and U.S. Pat. No. 7,069,639 patented Jul. 4, 2006 to M. H. Choi et al and assigned to Ceratech Corporation on a "Method Of Making Chip Type Power Inductor"; and U.S. Pat. No. 7,091,412 patented Aug. 15, 2006 to X. Wang et al and assigned to Nanoset, LLC on a "Magnetically Shielded Assembly"; and U.S. Pat. No. 7,140,092 patented Nov. 28, 2006 to J. W. Park et al and assigned to Georgia Tech Research Corporation on "Methods For Manufacturing Inductor Cores"; and U.S. Pat. No. 7,262,482 patented Aug. 28, 2007 to K. Y. Ahn et al and assigned to Micron Technology, Inc. on an "Open Pattern Inductor"; and U.S. Pat. No. 7,262,680 patented Aug. 28, 2007 to Albert Z. H. Wang and assigned to Illinois Institute of Technology of Chicago, Ill.; and U.S. Pat. No. 7,277,000 patented Oct. 2, 2007 to Masaki Suzui et al and assigned to Canon Kabushiki Kaisha of Tokyo, Japan on an "Inductor and Transformer"; and U.S. Pat. No. 7,294,366 patented Nov. 13, 2007 to M. J. Renn et al and assigned to Optomec Design Company on a "Laser Processing For Heat-Sensitive Mesoscale Deposition"; and U.S. Pat. No. 7,319,599 patented Jan. 15, 2008 to K. Hirano et al and assigned to Matsushita Elecdtric Industrial Co., Ltd. on a "Module Incorporating A Capacitor, Method For Manufacturing The Same, And Capacitor Used Therefor"; and U.S. Pat. No. 7,330,369 patented Feb. 12, 2008 to B. Tran on a "Nano-Electronic Memory Array"; and U.S. Pat. No. 7,375,417 patented May 20, 2008 to B. Tran on "Nano Packing"; and U.S. Pat. No. 7,380,328 patented Jun. 3, 2008 to K. Y. Ahn et al and assigned to Micron Technology, Inc. on a "Method Of Forming An Inductor"; and U.S. Pat. No. 7,390,477 patented Jun. 24, 2008 to R. E. Smalley et al and assigned to William Marsh Rice University on "Fullerene Nanotube Compositions"; and U.S. Pat. No. 7,400,512 patented Jul. 15, 2008 to K. Hirano et al and assigned to Matsushita Electric Industrial Co., Ltd. on a "Module Incorporating A Capacitor, Method For Manufacturing The Same, And Capacitor Used Therefor"; and U.S. Pat. No. 7,419,624 patented Sep. 2, 20078 to R. E. Smalley et al and assigned to William Marsh Rice University on "Methods For Producing Composites Of Fullerene Nanotubes And Compositions Thereof"; and U.S. Pat. No. 7,420,452 patented Sep. 2, 2008 to Sheng-Yuan Lee et al and assigned to VIA Technologies, Inc. of Taipei Hsien (TW) on an "Inductor Structure"; and U.S. Pat. No. 7,481,989 patented Jan. 27, 2009 to R. E. Smalley et al and assigned to William Marsh Rice University on a "Method For Cutting Fullerene Nanotubes"; and U.S. Pat. No. 7,485,366 patented Feb. 3, 2009 to X. Ma et al and assigned to Inframat Corporation on "Thick Film Magnetic Nanoparticulate Composites And Method Of Manufacture Thereof"; and U.S. Pat. No. 7,489,537 patented Feb. 10, 2009 to B. Tran on a "Nano-Electronic Memory Array"; and U.S. Pat. No. 7,567,163 patented Jul. 28, 2009 to M. Dadafshar et al and assigned to Pulse Engineering, Inc. on "Precision Inductive Devices And Methods"; and U.S. Pat. No. 7,791,445 patented Sep. 7, 2010 to D. M. Manoukian et al and assigned to Cooper Technologies Company on "Low Profile Layered Coil And Cores For Magnetic Components".

SUMMARY OF THE INVENTION

The present invention discloses a compact high short circuit current reactor having a unique core structure with at least two uniquely positioned coils positioned for flux cancellation through common core sections positions therebetween. The structure of the inductor defines a unique core construction which includes an upper and horizontal core section defining an upper end lower abutment surface oriented facing downwardly. A first upper vertical core section is also included which is in abutting contact with the upper end lower abutment surface of the upper end horizontal core section and extends downwardly therefrom. Similarly a second upper vertical core section is positioned in direct abutting contact with respect to an upper end lower abutment surface of the upper end horizontal core section and extends downwardly therefrom at a position along the upper end horizontal core section spatially disposed from the first vertical core section. Also includes in the core construction is a first common horizontal core section which defines a first common upper abutment surface oriented facing upwardly therefrom and defining a first common lower abutment surface oriented facing downwardly therefrom. The first common abutment surface of the first common horizontal core section is in abutment with the first upper vertical core section and with the second upper vertical core section. The first common horizontal core section as well as the upper end horizontal core section and the first upper vertical core section and the second upper vertical core section together define an upper internal core zone therebetween.

An upper internal core assembly is positioned within the upper internal core zone extending from the upper end lower abutment surface to the first common upper abutment surface and includes a first upper internal core section positioned within the upper internal core zone in abutment with the upper end lower abutment surface of the upper end horizontal core section in a position to extend downwardly therefrom at a position between said first upper vertical core section and said second upper vertical core section. A second upper internal core section is positioned within the upper internal core zone in abutment with the first common upper abutment surface of the first common horizontal core section and extending upwardly therefrom at a position spatially disposed from the first upper vertical core section and the second upper vertical core section. One or more third upper internal core sections are positioned within the upper internal core zone between the first upper internal core section and the second upper internal core section. Each third upper internal core section is spatially disposed from both the first upper internal core section and the second upper internal core section and is spatially disposed from one another when more than one third upper internal core section is included. In this manner upper internal core gaps will be defined between the individual core sections of the upper internal core assembly.

An upper coil member will extend through the upper internal core zone and extend around the upper internal core assembly to facilitate electromagnetic interaction therewith.

A first intermediate vertical core section will be positioned in abutting engagement with the first common lower abutment surface of the first common horizontal core section and will extend downwardly therefrom. Similarly a second intermediate vertical core section will be included in abutting engagement with respect to the first common lower abutment surface of the first common horizontal core section and will extend downwardly therefrom at a position spatially disposed from the location of the first intermediate vertical core section.

A second common horizontal core section will define a second common upper abutment surface oriented facing upwardly therefrom and also will define a second common lower abutment surface oriented facing downwardly therefrom. The second upper abutment surface and the second common horizontal core section will be in direct abutting engagement with the first intermediate vertical core section and with the second intermediate vertical core section. The first common horizontal core section along with the second common horizontal core section in association with the first intermediate vertical core section and the second intermediate vertical core section will together define therebetween the intermediate internal core zone.

An intermediate internal core assembly will be positioned within this intermediate internal core zone and will extend from the first common lower abutment surface to the second common upper abutment surface and will include three individual intermediate internal core sections. The first intermediate internal core section will be positioned within the intermediate internal core zone in abutment with the first common lower abutment surface of the first common horizontal core section and will extend downwardly therefrom at a position between the first intermediate vertical core section and the second intermediate vertical core section. The second of the intermediate internal core sections will be positioned within the intermediate internal core zone in abutment with the second common upper abutment surface and the second common horizontal core section and will extend upwardly therefrom at a position between the first intermediate vertical core section and the second intermediate vertical core section. One or more third intermediate internal core sections will be included positioned within the intermediate internal core zone between the first intermediate internal core section and the second intermediate internal core section. The adjacent of the third intermediate internal core sections will be spatially disposed from the first intermediate internal core section and will be also spatially disposed from the second intermediate internal core section. Where only one third intermediate internal core section is utilized this single section will itself be spaced above from the first intermediate internal core section and below from the second intermediate internal core section. In this manner intermediate internal core gaps will be defined between the third intermediate internal core section and any immediately adjacent intermediate internal core sections.

An intermediate coil member will extend through the intermediate internal core zone and will extend around the intermediate internal core assembly to facilitate electromagnetic interaction therewith. The upper coil member will be positioned immediately adjacent to the first common upper abutment surface of the first common horizontal core section and the intermediate core member will be positioned immediately adjacent to the first common lower abutment surface of the first common horizontal core section in order to introduce 120 degree flux cancellation within the first common horizontal core section.

This unique core construction will include a first lower vertical core section in abutment with respect the second common lower abutment surface of the second common horizontal core section and will extend downwardly therefrom. A second lower vertical core section will also be included in direct and sole abutment with respect to the second common lower abutment surface of the second common horizontal core section and extending downwardly therefrom at a position spatially disposed from the first lower vertical core section.

A lower end horizontal core section will be included defining a lower end upper abutment surface oriented facing upwardly and in abutment with the first lower vertical core section and with the second lower vertical core section. This second common horizontal core section along with the first lower vertical core section in combination with the second lower vertical core section and the lower end horizontal core section will together define therebetween the lower internal core zone.

A lower internal core assembly will be positioned within this lower internal core zone which will extend from the second common lower abutment surface to the lower end upper abutment surface. The lower internal core assembly will include three lower internal core sections. A first lower internal core section will be positioned within the lower internal core zone in abutment with the second common lower abutment surface of the second common horizontal core section and will extend downwardly therefrom at a position between the first and second lower vertical core sections. A second lower internal core section will be positioned within the lower internal core zone in abutment with the lower end abutment surface of the lower end horizontal core section and will extend upwardly therefrom at a position between the first lower vertical core section and the second lower vertical core section. One or more third lower internal core sections will be positioned within the lower internal core zone between the first lower internal core section and the second lower internal core section. The one or more third lower internal core sections will be spatially disposed from the first lower internal core section and spatially disposed from the second lower internal core section and, if more than one third lower internal core section is included, it will be spatially disposed from one another also to define lower internal core gaps therebetween to enhance operating characteristics of the core construction.

A lower coil member will be positioned extending through the lower internal core zone and around the lower internal core assembly to facilitate electromagnetic interaction therewith. This intermediate coil member will be positioned immediately adjacent to the second common upper abutment surface of the second common horizontal core section and the lower core member will be positioned immediately adjacent to the second common lower abutment surface of the common horizontal core section for the purpose of introducing 120 degree flux cancellation within the second common horizontal core section.

Each of the three zones will include an adhesive means which is preferably a glue material. This adhesive or glue will be positioned at the six points of abutting contact between core sections adjacent each of the three zones. The upper zone adhesive means will include first upper glue material positioned at the location of abutment between the first upper vertical core section and the upper and lower abutment surface. The upper zone adhesive means will also include a second upper glue material positioned at the location of abutment between the first upper vertical core section and the first common upper abutment surface. A third upper glue material will be positioned at the location of abutment between the second upper vertical core section and the upper end lower abutment surface. The fourth upper. glue material will be positioned at the location of abutment between the second upper vertical core section and the first common upper abutment surface. The fifth upper glue material will be positioned at the location of abutment between the first upper internal core section and the upper end lower abutment surface. Finally a sixth upper glue material will be positioned at the location of abutment between the second upper internal core sections and the first common upper abutment surface.

A similar construction of six individual glue materials or layers will be included at correspondingly similar locations adjacent the intermediate internal core zone and adjacent the lower internal core zone. The use of these glue abutting surfaces and the absence of any interleaving engagement between the stacking layers of the individual core sections facilitates the capability of varying the width of the upper internal core gaps and the intermediate internal core gaps and the lower internal core gaps.

It is an object of the present invention to provide a compact high short circuit current reactor which provides a core structure which is assembled with a plurality of butt joints without interleaving which greatly facilitates varying of the dimensions of various portions of the inductor core structure to facilitate customization in the sizing of the gaps defined between the internal core sections which are adjacent to one another.

It is an object of the present invention to provide a compact high short circuit current reactor which facilitates rapid assembly and facilitates construction.

It is an object of the present invention to provide a compact high short circuit current reactor which provides minimal maintenance requirements.

It is an object of the present invention to provide a compact high short circuit current reactor which minimizes the initial capital cost outlay for construction as well as basic parts costs.

It is an object of the present invention to provide a compact high short circuit current reactor which provides the full capabilities of a three phase line inductor usable in multiple applications.

It is an object of the present invention to provide a compact high short circuit current reactor which provides a core structure which includes 120 degree flux cancellation through the use of common yoke sections positioned between coil which are vertically adjacent to one another with a common yoke extending therebetween.

It is an object of the present invention to provide a compact high short circuit current reactor which includes coil conductor material of wire or foil which can be made of aluminum or copper or other similar materials.

It is an object of the present invention to provide a compact high short circuit current reactor which provides a core made of silicon steel which can be grain oriented or non-oriented as desired.

It is an object of the present invention to provide a compact high short circuit current reactor which can be made of various sizes, shapes and configurations and which defines gaps between internal core sections positioned immediately adjacent to one another.

It is an object of the present invention to provide a compact high short circuit current reactor which can be constructed with varying different sizes of vertical shunts or external core sections to facilitate the defining of various dimensions for the gaps defined between adjacent internal core sections.

It is an object of the present invention to provide a compact high short circuit current reactor which can be formed with various sizes of internal core sections to vary the pre-defined gaps positioned therebetween.

It is an object of the present invention to provide a compact high short circuit current reactor which utilizes direct butt joints between the yokes and external core sections or shunt sections without any interleaving of the structural member thereof therebetween.

BRIEF DESCRIPTION OF THE DRAWINGS

While the invention is particularly pointed out and distinctly described herein, a preferred embodiment is set forth in the following detailed description which may be best understood when read in connection with the accompanying drawings, in which.

DETAILED DESCRIPTION OF THE PREFERRED EMBODIMENT

Figure 1:
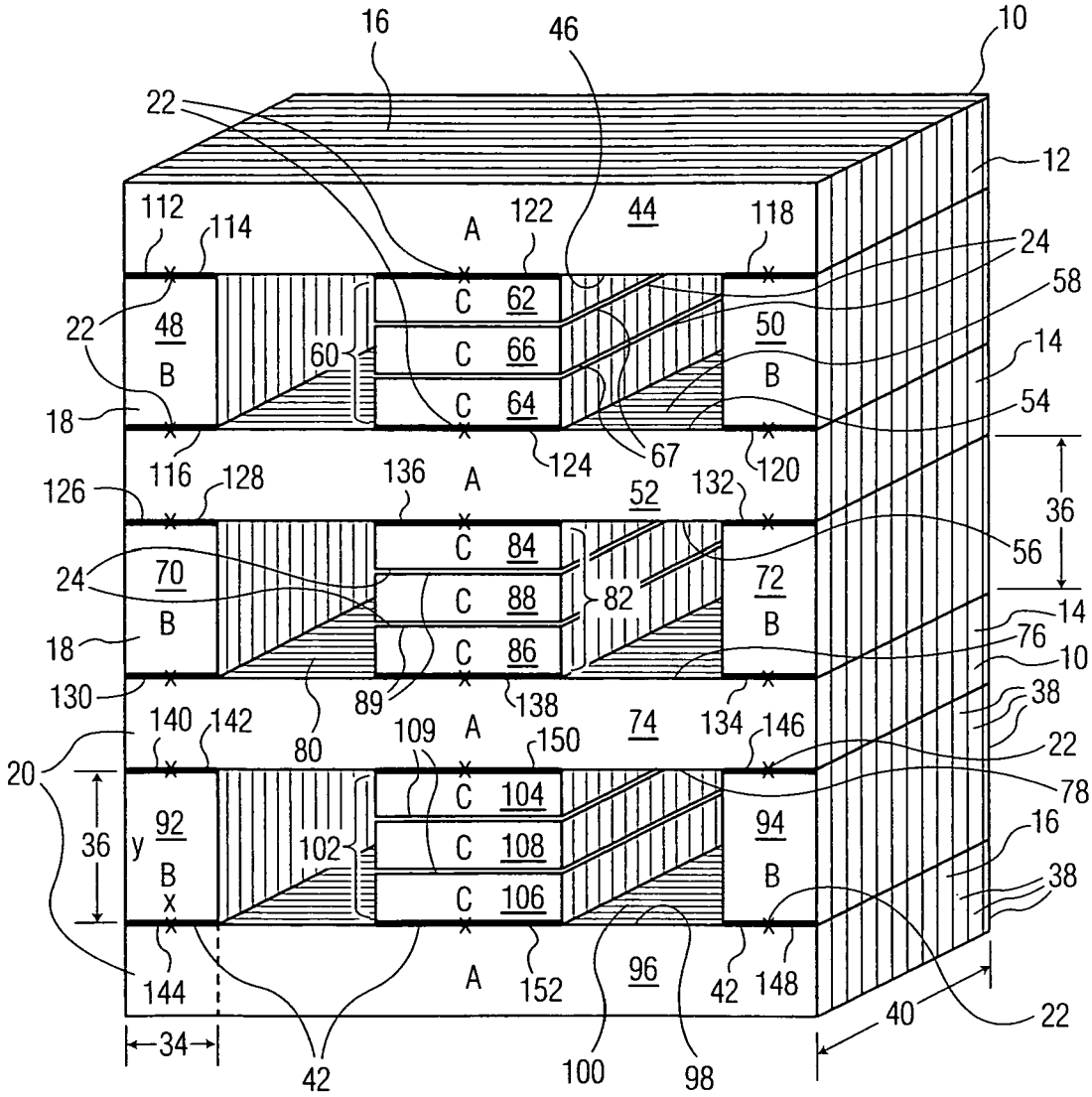
FIG. 1 is a front three-quarter perspective illustration of an embodiment of a core structure usable with the compact high short circuit current reactor of the present invention.

The present invention provides a unique construction for the core of a compact high short circuit current inductor also commonly identified as a reactor which includes a specialized core structure 10 assembled with a plurality of individual structural sections interconnected with respect to one another and including a plurality of butt interfaces 22 positioned therebetween. The core structure 10 preferably includes a plurality of yokes or horizontal core section 12 which are shown in this embodiment as core sections or shunts which extend generally horizontally. These sections are shown in FIG. 1 also bearing the alternative designation "A".

The core construction includes a plurality of vertical core yokes, sections or shunts 18 positioned extending generally vertically between the individual yokes 12 and interfacing therewith at a plurality of butt interfaces 22. Positioned within this rectangular array of generally horizontally extending yokes 12 and the generally vertically extending external core shunt sections 18 are a plurality of internal core sections 20 extending generally horizontally. These sections 20 are commonly known as the internal core sections because they are centrally positioned within the inductance coils 23 of the fully assembly reactor construction. These internal core sections 20 are also shown in FIG. 1 using the reference character "C". The vertical shunts 18 or vertical core sections 18 are also known as external core sections 18 because they are located immediately outside of and adjacent to the coils 23 in the final reactor construction. These external core sections 18 are also shown using the reference character "B" in FIG. 1.

Figure 4:
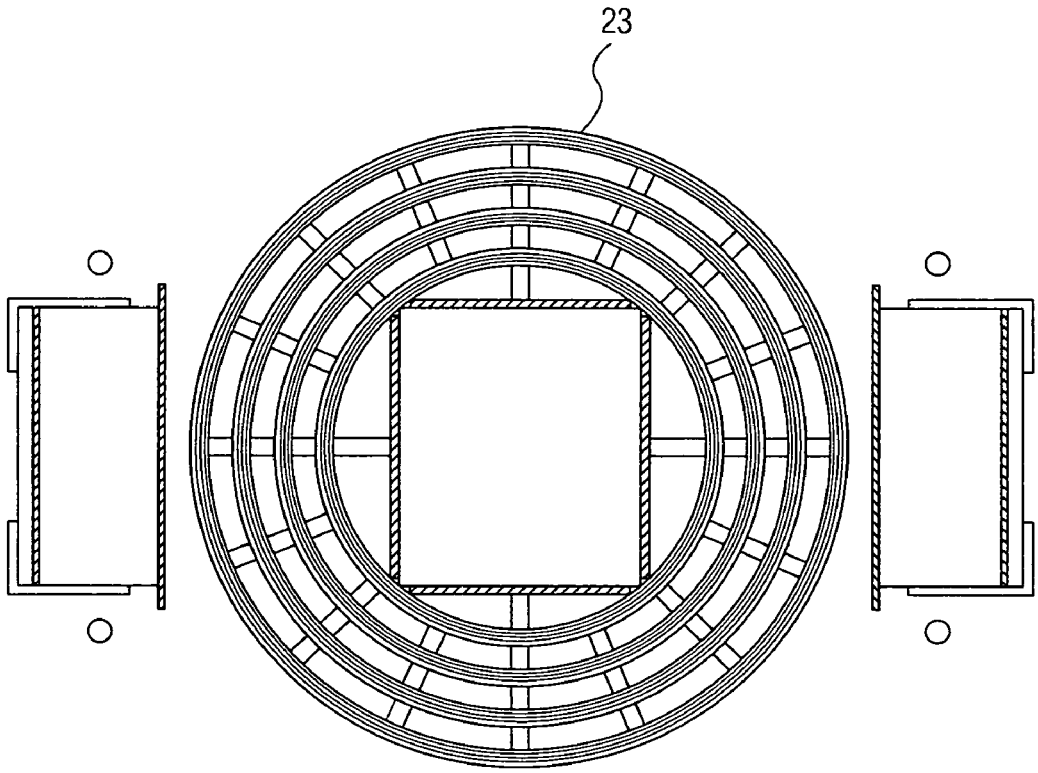
FIG. 4 is a cross-sectional view of FIG. 3 taken along lines A-A.
Figure 5:
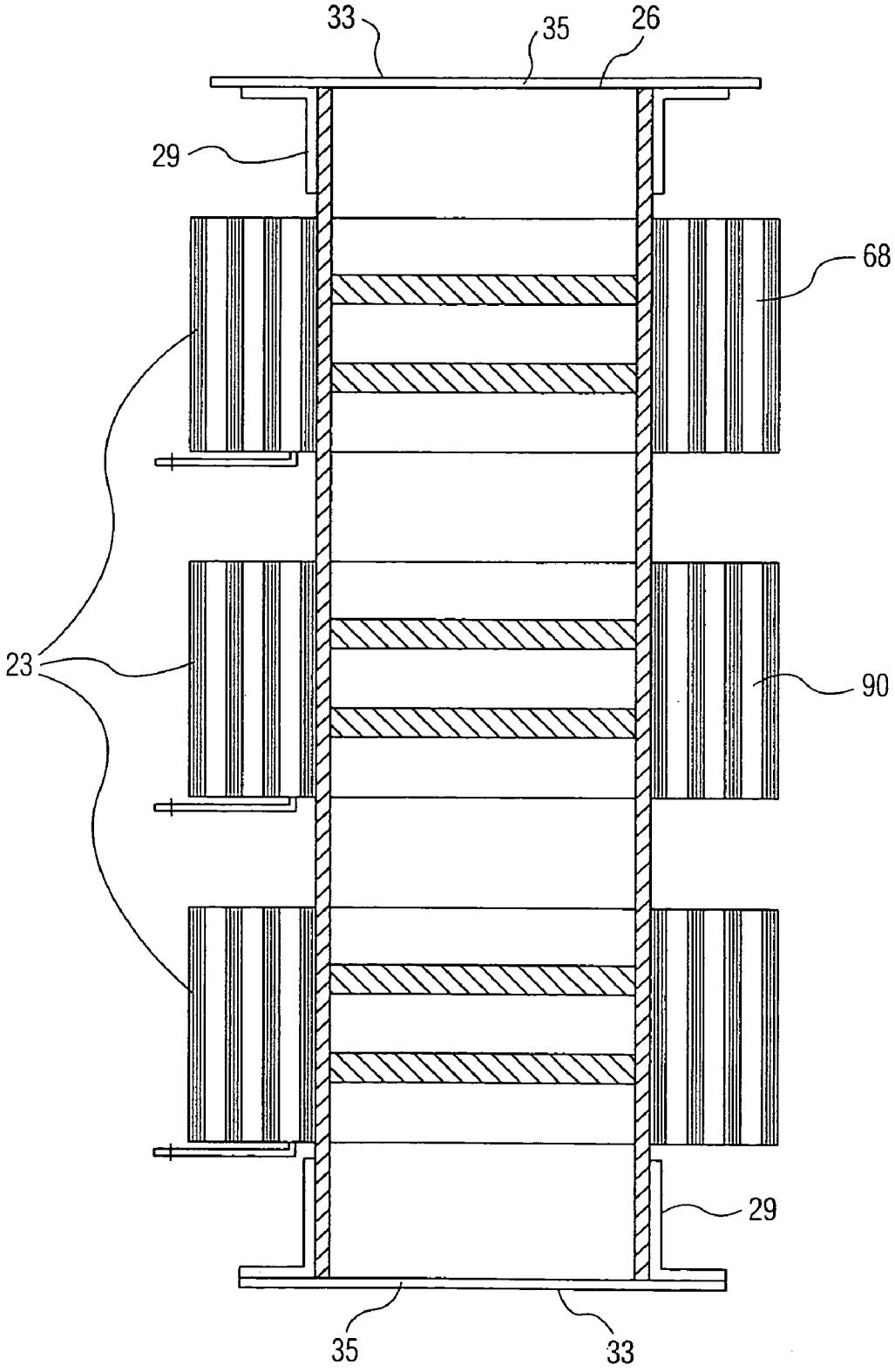
FIG. 5 is a cross-sectional view of FIG. 2 taken along lines B-B.

FIGS. 4 and 5 show the positioning of the coils 23 which are stacked generally in the vertical direction as shown best in FIG. 5 when positioned about the internal core sections 20 or C as shown in FIG. 1. As such, in this particular embodiment, there are three vertically stacked coil 23, namely, the upper coil member 68, the intermediate coil member 90 and the lower coil member 110. Each of these vertically stacked coils, 68 above 90 above 110, includes an internal core section 20 positioned therewithin. These internal core sections should be separated from one another by internal core gaps 24 located between adjacent internal core sections 20 to enhance operating characteristics thereof and facilitate the ability to customize at the time of initial construction of the core. Thus, as shown in FIG. 1, the individual internal core sections 20 which are adjacent to similar to internal core sections 20 will define internal core gaps 24 therebetween having specifically predefined dimensions. However, at the location where the internal core sections 20 are located adjacent to one of the horizontal core secti0on 12 rather than another internal core section there is a directly abutting interface 22. As such, when viewing FIG. 1 in this embodiment of this construction there are exactly eighteen butt interfaces 22 between sections of the final core construction 10. Twelve of these butt interfaces 22 are located at the outer lateral periphery of the construction between the external core sections 18 and the yokes 12 immediately thereadjacent. Six of the butt interfaces 22 are located between the internal core sections 20 and the horizontal core sections 12 positioned either immediately thereabove or immediately therebelow. Thus, it is important to understand that in this construction the gaps 24 only need to be defined at the interfaces between adjacent surfaces of the internal core sections 20 and need not be defined at the interfaces between the internal core sections 20 and the horizontal core sections 12 located immediately thereabove or immediately therebelow.

One of the important enhancements of the present invention is the 120 degree flux cancellation made possible by the vertical stacking of the internal core sections 20 and the positioning of common yokes 14 therebetween. The common yokes 14, as shown in FIG. 1, comprise the two more centrally located yokes 12, more specifically referenced as first common horizontal core section 56 and second common horizontal core section 74. Each of these common yokes 14 are positioned both above and below one of the plurality of internal core sections 20 which will be positioned within each coil 23. As such, with the use of the common yokes 14, a 120 degrees flux cancellation will be structurally introduced at all times during operation of the inductor which will greatly enhance operating characteristics. The end yokes 16 comprise those of the yokes 12 which are located either at the very top of the construction or at the very bottom of the construction as shown best in FIG. 1. These end yokes will not introduce any flux cancellation because they do not include a coil positioned both above and below thereof.

One of the important characteristics of the present design is made apparent by analyzing the detailed construction of the individual sections within the core structure 10. Each of the yokes 12, the external core sections 18 and the internal core sections 20 are formed by assembling a stack of individual stacking members 38. Each stacking member 38 will preferably be formed from relatively thin steel material, being normally approximately 0.012 inches in total thickness. This thickness can vary somewhat, however, the importance of this construction is that a number of these thin individual stacking members need to be stacked with respect to one another in a planar manner to construct a core section having the desired total stack height 40. The length and width of each stacking member will vary depending upon the dimensions required for the final core structural member.

As shown best in FIG. 1, the individual stacking members 38 which are generally flat as well as being usually generally rectangular or square in configuration can be stacked with respect to one another to form or assemble a stack of stacking members to form the structural sections of the core 10. For example, in FIG. 1 the external core section 18 is shown formed of a plurality of stacking members 38 each of which preferably is relatively thin and has a horizontal and vertical dimension defined as the first dimension 34 and the second dimension 36. Normally dimension 36 will be somewhat greater than dimension 34 to form a thin rectangular shape to build or construction the individual core sections. The external core section 18 at the lower left portion of FIG. 1 shows the first dimension 34 which is also defined as X and the vertical dimension 36 which is also defined as Y. Thus, the stacking members 38 will be sandwiched together as shown in the rightmost portion of FIG. 1. Vertically lining is included to only schematically illustrate the sandwich-like construction of each core section A, B or C. External core sections 18 achieve the overall total dimension required by stacking the 0.012" thick stacking members, each of which will have a width of X and a length of Y. A plurality of these stacking members will be positioned adjacent to one another and placed on end in order to construct each of the three different core sections as shown in FIG. 1, namely horizontal yokes 12, external core sections or vertical shunts 18 and horizontal core sections or internal core sections 20. The particular number of stacking members 38 utilized to form an external core section 18 will be determined as desired in order to achieve the desired stack height 40 as shown in FIG. 1.

It should be appreciated that in prior art constructions the individual stacking members 38 in each of the sections of the core structure 12 are often not maintained in abutting alignment with one another, but are positioned in an overlapping or interleaved engaging manner similar to conventional construction of bricks or blocks used in wall constructions or brick facades. This overlapping or interleaved engagement between the individual stacking members in one core section with the stacking members in another core section greatly facilitates interlocking engagement between adjacent sections of the core structure. For example, the individual stacking members 38 which together define each of the external core sections 18 could be positioned such as not to be in alignment with respect to one another such that they can be interleaved with and, thusly, engaged with respect to the stacking members 38 that make up an adjacently positioned core structural component. By eliminating this interleaving configuration and forming the interfaces between structural components of the core structure as butt joints rather than interleaved joints, the vertical dimension within which the internal core sections 20 are positioned can be more easily be controlled and varied from one customized design to another which significantly enhances the ability to vary the size of the gaps 24 defined between adjacent internal core sections 20 to control desired variations in the operating characteristics of the inductance core. The size of these gaps 24 can also be varied in some designs by varying the X or Y dimension of the stacking members 38 utilized to construct the internal core sections 20 because the vertical and horizontal shunts are interconnected with butt joints only and not interleaved joints.

Figure 2:
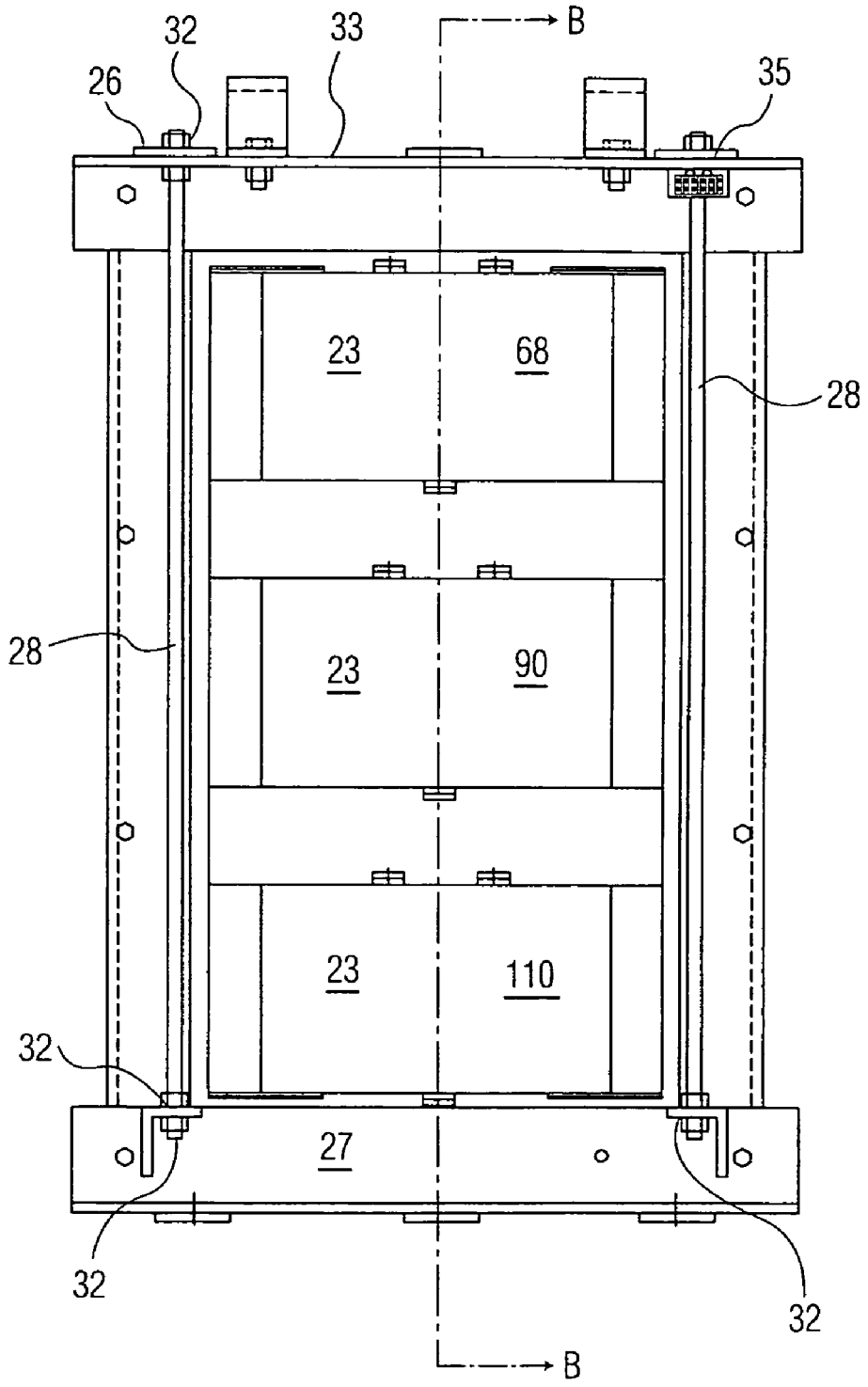
FIG. 2 is front plan view of the fully assembled reactor construction showing all parts clamped in position.
Figure 3:
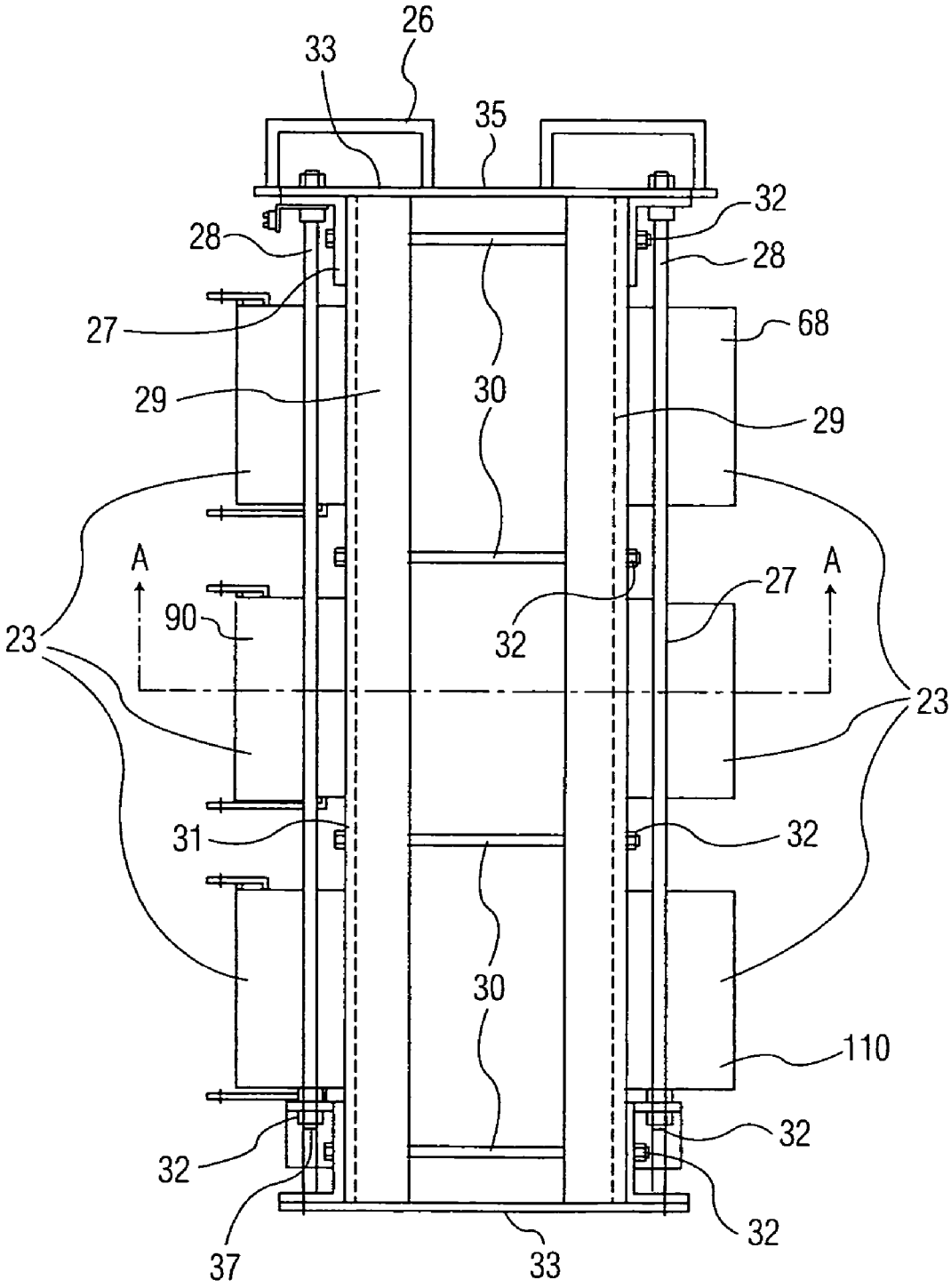
FIG. 3 is a side plan view of the embodiment shown in FIG. 2.

When the core structure 10 is finally assembled it will be held together by an adhesive 42 such as glue, or similar material, as well as held together by a clamping means 26 shown best in FIGS. 2 and 3. Glue will be place at all locations of the butt joints for securement thereof which will enhance attachment between the abutting ends without requiring an interleaving of the stacking members 38 to achieve securement therebetween. This clamping means 26 will include vertically extending rods 28 and horizontally extending rods 30 with a plurality of securement members 32 such as nuts or the like secured to the end portions thereof preferably being threadably engaged therewith which can hold the overall configuration of the core structure 10 tightly held together in all directions. Normally this gluing step takes place during and/or after assembly and immediately prior to a final varnishing step. It should be appreciated that the combination of the ability to carefully and accurately and easily control the size of the gaps between the internal core sections 20 and the enhancement achieved by the cancellation present in the common yokes 14 provides an overall enhanced construction for the compact high short circuit current reactor of the present invention which achieves enhanced operating characteristics not available in any inductor design available heretofore.

The sizing of the gaps in the core areas are critical to specific inductor performance and for maintaining of optimal operating characteristics thereof. It is this combination of the common yoke construction facilitating flux cancelation and the glued butt joints between sections of the core construction which yields a more effective and controllable structure for the inductor with improved efficiency in all aspects of overall performance.

The coils 23 of the present invention can be either square or round in cross-sectional shape and are preferably oriented in a vertically stacked configuration. This configuration provides two main advantages. The first advantage is in the flux cancellation provided in the common yokes 14, and the second advantage is in the more compact overall design achievable. The material of the coil can be either aluminum or copper wire or foil or other materials.

It should be appreciated that all components of the core structure 10 including the yokes 12 and the external core sections 18 and the internal core sections 20 are preferably formed of a steel material which can be grain-oriented or non-grain-oriented.

For the purposes of an example only, the preferred dimensions of the individual stacking members 38 should be 0.012 inches thick and the X dimension 34 can be 4 or 5 inches, whereas the Y dimension or dimension 36 can be in a range between 6 to 12 inches. However, each of these dimensions can vary greatly and will be chosen for each different particular application as desired to vary the overall size and configuration of the finally formed structural member of the core 12 formed by stacking of the individual stacking members 38 to the desired stack height 40 and to achieve the desired operating characteristics of the particular application being addressed.

It should be appreciated that the preferred construction of the present invention as shown in the figures of the present invention wherein three vertical coils 23 are positioned within three vertically stacked internal core zones. It should be appreciated, however, that the principle of the present invention could be included wherein only two zones and two coils are utilized or four or more coils and internal core zones can be utilized. With a two zone inductor construction there will only be two coils whereas with a four zone construction there would obviously be four coils or more in larger units. This description is of the specific embodiment shown in FIGS. 1-5 of the present invention. However, it should be appreciated that the construction can be utilized with variations of this configuration wherein instead of three coils a two coil or a four or more coil configuration is utilized. The specific present invention utilizing two coils, however, will include an upper end horizontal core section 44 extending generally horizontally above the uppermost portion of the core construction. The upper end horizontal core section 44 defines an upper end lower abutment surface 46 facing downwardly therefrom. A first upper vertical core section 48 will be positioned extending downwardly from the upper and lower abutment surface 46 of upper end horizontal core section 44. Similarly a second upper vertical core section 50 will extend downwardly from the upper end lower abutment surface 46 at a position spatially disposed from the first upper vertical core section 48 to initiate defining therebetween of the upper internal core zone 58. A first common horizontal core section 52 will be positioned below the first and second upper vertical core sections 48 and 50 and will include a first common upper abutment surface 54 facing upwardly therefrom and a first common lower abutment surface 56 facing downwardly therefrom. As such, with this construction the upper internal core zone 58 will specifically be defined by the upper end lower abutment surface 46 on the top and on the bottom it will be defined by the first common upper abutment surface 54 and on the sides it will be defined by the first upper vertical core section 48 and the second upper vertical core section 50.

An upper internal core assembly 60 will be positioned within the upper internal core zone 58 and will include a first upper internal core section 62 in direct abutting connection with respect to the upper end lower abutment surface 46. Similarly the second upper internal core section 64 will be positioned below the first upper internal core section 62 and will be in direct abutment with respect to the first common upper abutment surface 54. One or more individual third upper internal core sections 66 will be positioned between the first upper internal core section 62 and the second upper internal core section 64 and will be spaced therefrom by predefined upper internal core gaps 67 for the purpose of predefining operating characteristics of the final inductor core construction. An upper coil member 68 will be positioned within the upper internal core zone 58 in such a position that it extends around the first, second and third upper internal core sections 62, 64 and 66 for inductive interaction with respect thereto.

In order to facilitate securement of the six abutting connections which secure the various core sections together to define the upper internal core zone 58 a plurality of locations will have glue applied thereto. In particular, within the upper zone the upper zone adhesive means 112 will include a first upper adhesive material 114 positioned at the location of abutment between the first upper vertical core section 48 and the upper end lower abutment surface 46. A second upper glue material 116 will be positioned at the location of abutment between the first upper vertical core section 48 and the first common upper abutment surface 54. The upper zone adhesive 112 will include a third upper adhesive material 118 positioned at the location of abutment between the second upper vertical core section 50 and the upper end lower abutment surface 46. A fourth upper adhesive material 120 will also be included positioned at the location of abutment between the second upper vertical core section 50 and the first common upper abutment surface 54. The upper zone adhesive 112 will further include a fifth upper adhesive 122 positioned at the location of abutment between the first upper internal core section 62 and the upper end lower abutment surface 46. Finally, the upper zone adhesive means 112 will include a sixth upper adhesive material 124 positioned at the abutting engagement location between the second upper internal core section 64 and the first common upper abutment surface 54.

The intermediate internal core zone 80 is initially defined by a first intermediate vertical core section 70 which is in direct abutment with respect to the first common lower abutment surface 56. A second intermediate vertical core section 72 is also positioned in direct abutment with respect to first common lower abutment surface 56 at a location spatially disposed from the first intermediate vertical core section 70. A second common horizontal core section 74 will be included having a second common upper abutment surface 76 facing upwardly therefrom and a second common lower abutment surface 78 extending downwardly therefrom. The second common upper abutment surface 76 will be in direct abutment with both the first intermediate vertical core section 70 and the second intermediate vertical core section 72 thereabove. With this configuration the intermediate internal core zone 80 will be defined laterally between the first intermediate vertical core section 70 and the second intermediate vertical core section 72 and will be defined vertically between the second common upper abutment surface 76 and the first common lower abutment surface 56. An intermediate internal core assembly 82 will then be positioned within the intermediate core zone 80. Intermediate internal core assembly 82 includes a first intermediate internal core section 84 in direct abutment with respect to the first common lower abutment surface 56. Intermediate internal core assembly 82 will also define a second intermediate internal core section 86 in direct abutment with the second common upper abutment surface 76. A third intermediate internal core section 88 will be positioned between first and second intermediate internal core sections 84 and 86 and spatially disposed with respect thereto to define intermediate internal core gaps 89 therebetween of pre-specified dimensions. These core gaps 89 will facilitate defining of the operating characteristics of the intermediate coil member 90 which is positioned within the intermediate internal core zone 80 surrounding the intermediate internal core assembly 82. The lower internal core zone 100 will be defined laterally by a first lower vertical core section 92 and a second lower vertical core section 94 each of which is in direct abutment with respect to the second common lower abutment surface 78 of second common core section 74 and positioned extending downwardly therefrom. A lower end horizontal core section 96 is also defined including a lower end upper abutment surface 98. Lower end upper abutment surface 98 is adapted to directly abut the undersurface of the first lower vertical core section 92 and the second lower vertical core section 94. In this manner the lower internal core zone 100 is defined vertically by the lower end upper abutment surface 98 and the second common lower abutment surface 78. Laterally lower internal core zone 100 is defined between the first lower vertical core section 92 and the second lower vertical core section 94.

A lower internal core assembly 102 is positioned within the lower internal core zone 100 and includes a first lower internal core section 104 abutting engaging second common lower abutment surface 78. A second lower internal core section 106 is included in direct abutting engagement with respect to the lower end upper abutment surface 98. At least one third lower internal core section 108 is positioned the first and second lower internal core sections 104 and 106 and is spatially disposed therefrom to define lower internal core gaps 108 therebetween. A lower coil member 110 is positionable within the lower internal core zone 100 extending around the lower internal core assembly 102 for inductive interaction therewith.

It should be appreciated that the construction of the core sections defining the intermediate internal core zone 80 and the lower internal core zone 100 use similar adhesives such as glue 42 and the like at the butt intersections between the structural components thereof. The intermediate core zone 80 is maintained structurally by the inclusion of an intermediate zone adhesive means 126. Intermediate zone adhesive means 126 includes six locations of the application of adhesives or glue materials 42. The intermediate zone adhesive means 126 includes a first intermediate adhesive or glue material 128 positioned at the location of abutment between the first intermediate vertical core section 70 and the first common lower abutment surface 56. A second intermediate adhesive material 130 is applied at the location of abutment between the first intermediate vertical core section 70 and the second common upper abutment surface 76. Intermediate zone adhesive 126 further includes a third intermediate glue or adhesive material 132 to be applied between the second intermediate vertical core section 72 and the first common lower abutment surface 56. Further included is a fourth intermediate glue material 134 positioned at the location of abutment between the second intermediate vertical core section 72 and the second common upper abutment surface 76. A fifth intermediate adhesive material 136 is applied at the location of direct abutment between the first intermediate internal core section 84 and the first common lower abutment surface 56. Finally, intermediate zone adhesive means 126 includes a sixth intermediate adhesive material 138 positioned between the second intermediate internal core section 86 and the second common upper abutment surface 76. With this construction firm and reliable securement of the abutting intersections defining the intermediate internal core zone 80 will be achieved.

Similar adhesive or glue materials are utilized to facilitate defining of the lower internal core zone 100. For this purpose a lower zone adhesive 140 is included having a first lower adhesive material 142 applied at the abutting connection between the first lower vertical core section 92 and the lower end upper abutment surface 98. Second lower adhesive material 144 will be positioned at the location of abutment between the first lower vertical core section 92 and the lower end upper abutment surface 98. Third lower glue material or adhesive 146 will be included positioned at the location of abutment between the second lower vertical core section 94 and the second common lower abutment surface 78. Lower zone adhesive 140 will further include a fourth lower adhesive material 148 positioned at the location of abutment between the second lower vertical core section 94 and the lower end upper abutment surface 98. A fifth lower glue material 150 will be applied at the location of abutment between the first lower internal core section 104 and the second common lower abutment surface 78. A sixth lower adhesive material 152 will be included in the lower zone adhesive 140 to be applied between the second lower internal core section 106 and the lower end upper abutment surface 98. With these six specific adhesive materials included in the lower zone adhesive means 140 the structural integrity of the lower internal core zone 100 will be achieved and control in the varying of the lower internal gaps 109 will be made possible.

One of the important characteristics of the present invention is in the use of the external clamping means 26 which can be used supplementary to the adhesive means or in replacement of the adhesive means for maintaining the structural integrity between the structural core sections A, B and C. External clamping means 26 can include a horizontal clamping means 27 including a plurality of vertically extending clamping plates 29 with horizontally extending rods 30 extending therethrough and defining first threaded ends 31 thereon. Securement nuts 32 are detachably securable with respect to the first threaded ends 31 of the rods 30 for the purposes of maintaining the horizontal abutting connections in full engagement. A vertical clamping means 33 may also be included having a plurality of horizontally extending clamping plates 35 with vertically extending rods 28 extending therethrough with the rods 28 defining second threaded ends 37. The nuts 32 can be secured to the seconded threaded ends 37 to achieve vertical clamping. As such, the combination of the vertical clamping means 33 and the horizontal clamping means 27 achieves an overall external clamping means 26 which can be utilized to maintain the integrity of the construction or to hold the construction together as the glue or adhesive utilized to maintain the connections proceeds to cure.

One of the most important advantages of the design of the proprietary core structure of the present invention is in the use of common yokes or common horizontal core sections shown in FIG. 1 as first common horizontal core section 52 and second common horizontal core section 74. The use of a common yoke enhances the operating characteristics by taking advantage of flux cancellations which allows the overall construction of the high short circuit current reactor or inductor to be made in a more compact manner.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

We claim:

1. A compact high short circuit current reactor comprising:

A. an upper end horizontal core section defining an upper end lower abutment surface orientated facing downwardly therefrom;

B. a first upper vertical core section in abutment with respect to said upper end lower abutment surface of said upper end horizontal core section and extending downwardly therefrom;

C. a second upper vertical core section in abutment with respect to said upper end lower abutment surface of said upper end horizontal core section and extending downwardly therefrom at a position spatially disposed from said first upper vertical core section;

D. a common horizontal core section defining a common upper abutment surface orientated facing upwardly therefrom and defining a common lower abutment surface oriented facing downwardly therefrom, said common upper abutment surface of said common horizontal core section being in abutment with said first upper vertical core section and with said second upper vertical core section, said common horizontal core section, said upper end horizontal core section, said first upper vertical core section and said second upper vertical core section together defining an upper internal core zone therebetween;

E. an upper internal core assembly positioned within said upper internal core zone extending from said upper end lower abutment surface to said common upper abutment surface and comprising:

(1) a first upper internal core section positioned within said upper internal core zone in abutment with said upper end lower abutment surface of said upper end horizontal core section and extending downwardly therefrom at a position spatially disposed from and between said first upper vertical core section and said second upper vertical core section;

(2) a second upper internal core section positioned within said upper internal core zone in abutment with said common upper abutment surface of said common horizontal core section and extending upwardly therefrom at a position spatially disposed from and between said first upper vertical core section and said second upper vertical core section;

(3) at least one third upper internal core section positioned within said upper internal core zone between first upper internal core section and said second upper internal core section, each of said third upper internal core sections being spatially disposed from said first upper internal core section and spatially disposed from said second upper internal core section and spatially disposed from one another to define upper internal core gaps therebetween;

F. an upper coil member extending through said upper internal core zone and extending around said upper internal core assembly to facilitate electromagnetic interaction therewith;

G. a first lower vertical core section in abutment with respect to said common lower abutment surface of said common horizontal core section and extending downwardly therefrom;

H. a second lower vertical core section in abutment with respect to said common lower abutment surface of said common horizontal core section and extending downwardly therefrom at a position spatially disposed from said first lower vertical core section;

I. a lower end horizontal core section defining a lower end upper abutment surface orientated facing upwardly and in abutment with said first lower vertical core section and with said second lower vertical core section, said common horizontal core section, said first lower vertical core section, said second lower vertical core section and said lower end horizontal core section together defining a lower internal core zone therebetween;

J. a lower internal core assembly positioned within said lower internal core zone and extending from said common lower abutment surface to said lower end upper abutment surface and comprising:

(1) a first lower internal core section positioned within said lower internal core zone in abutment with said common lower abutment surface of said common horizontal core section and extending downwardly therefrom at a position between said first lower vertical core section and said second lower vertical core section;

(2) a second lower internal core section positioned within said lower internal core zone in abutment with said lower end upper abutment surface of said lower end horizontal core section and extending upwardly therefrom at a position between said first vertical core section and said second vertical core section;

(3) at least one third lower internal core section positioned within said lower internal core zone between first lower internal core section and said second lower internal core section, each of said third lower internal core sections being spatially disposed from said first lower internal core section and spatially disposed from said second lower internal core section and spatially disposed from one another, to define lower internal core gaps therebetween; and K. a lower coil member extending through said lower internal core zone and extending around said lower internal core assembly to facilitate electromagnetic interaction therewith.

2. A compact high short circuit current reactor comprising:

A. an upper end horizontal core section defining an upper end lower abutment surface orientated facing downwardly therefrom;

B. a first upper vertical core section in abutment with said upper end lower abutment surface of said upper end horizontal core section and extending downwardly therefrom;

C. a second upper vertical core section in abutment with said upper end lower abutment surface of said upper end horizontal core section and extending downwardly therefrom at a position spatially disposed from said first upper vertical core section;

D. a first common horizontal core section defining a first common upper abutment surface orientated facing upwardly therefrom and defining a first common lower abutment surface oriented facing downwardly therefrom, said first common upper abutment surface of said first common horizontal core section being in abutment with said first upper vertical core section and with said second upper vertical core section, said first common horizontal core section, said upper end horizontal core section, said first upper vertical core section and said second upper vertical core section together defining an upper internal core zone therebetween;

E. an upper internal core assembly positioned within said upper internal core zone extending from said upper end lower abutment surface to said first common upper abutment surface and comprising:

(1) a first upper internal core section positioned within said upper internal core zone in abutment with said upper end lower abutment surface of said upper end horizontal core section and extending downwardly therefrom at a position spatially disposed from and between said first upper vertical core section and said second upper vertical core section;

(2) a second upper internal core section positioned within said upper internal core zone in abutment with said first common upper abutment surface of said first common horizontal core section and extending upwardly therefrom at a position spatially disposed from and between said first upper vertical core section and said second upper vertical core section;

(3) at least one third upper internal core section positioned within said upper internal core zone between first upper internal core section and said second upper internal core section, each of said third upper internal core sections being spatially disposed from said first upper internal core section and spatially disposed from said second upper internal core section and spatially disposed from one another to define upper internal core gaps therebetween;

F. an upper coil member extending through said upper internal core zone and extending around said upper internal core assembly to facilitate electromagnetic interaction therewith;

G. a first intermediate vertical core section in abutment with said first common lower abutment surface of said first common horizontal core section and extending downwardly therefrom;

H. a second intermediate vertical core section in abutment with said first common lower abutment surface of said first common horizontal core section and extending downwardly therefrom at a position spatially disposed from said first intermediate vertical core section;

I. a second common horizontal core section defining a second common upper abutment surface orientated facing upwardly therefrom and defining a second common lower abutment surface oriented facing downwardly therefrom, said second common upper abutment surface of said second common horizontal core section being in abutment with said first intermediate vertical core section and with said second intermediate vertical core section, said first common horizontal core section, said second common horizontal core section, said first intermediate vertical core section and said second intermediate vertical core section together defining an intermediate internal core zone therebetween;

J. an intermediate internal core assembly positioned within said intermediate internal core zone and extending from said first common lower abutment surface to said second common upper abutment surface and comprising:

(1) a first intermediate internal core section positioned within said intermediate internal core zone in abutment with said first common lower abutment surface of said first common horizontal core section and extending downwardly therefrom at a position between said first intermediate vertical core section and said second intermediate vertical core section;

(2) a second intermediate internal core section positioned within said intermediate internal core zone in abutment with said second common upper abutment surface of said second common horizontal core section and extending upwardly therefrom at a position between said first intermediate vertical core section and said second intermediate vertical core section;

(3) at least one third intermediate internal core section positioned within said intermediate internal core zone between first intermediate internal core section and said second intermediate internal core section, each of said third intermediate internal core sections being spatially disposed from said first intermediate internal core section and spatially disposed from said second intermediate internal core section and spatially disposed from one another to define intermediate internal core gaps therebetween;

K. an intermediate coil member extending through said intermediate internal core zone and extending around said intermediate internal core assembly to facilitate electromagnetic interaction therewith;

L. a first lower vertical core section in abutment with respect to said second common lower abutment surface of said second common horizontal core section and extending downwardly therefrom;

M. a second lower vertical core section in abutment with respect to said second common lower abutment surface of said second common horizontal core section and extending downwardly therefrom at a position spatially disposed from said first lower vertical core section;

N. a lower end horizontal core section defining a lower end upper abutment surface orientated facing upwardly and in abutment with said first lower vertical core section and with said second lower vertical core section, said second common horizontal core section, said first lower vertical core section, said second lower vertical core section and said lower end horizontal core section together defining a lower internal core zone therebetween;

O. a lower internal core assembly positioned within said lower internal core zone and extending from said second common lower abutment surface to said lower end upper abutment surface and comprising:

(1) a first lower internal core section positioned within said lower internal core zone in abutment with said second common lower abutment surface of said second common horizontal core section and extending downwardly therefrom at a position between said first lower vertical core section and said second lower vertical core section;

(2) a second lower internal core section positioned within said lower internal core zone in abutment with said lower end upper abutment surface of said lower end horizontal core section and extending upwardly therefrom at a position between said first lower vertical core section and said second lower vertical core section;

(3) at least one third lower internal core section positioned within said lower internal core zone between said first lower internal core section and said second lower internal core section, each of said third lower internal core sections being spatially disposed from said first lower internal core section and spatially disposed from said second lower internal core section and spatially disposed from one another to define lower internal core gaps therebetween; and P. a lower coil member extending through said lower internal core zone and extending around said lower internal core assembly to facilitate electromagnetic interaction therewith.

3. A compact high short circuit current reactor as defined in claim 2 further including an upper zone adhesive means comprising:

A. a first upper adhesive material positioned at the location of abutment between said first upper vertical core section and said upper end lower abutment surface;

B. a second upper adhesive material positioned at the location of abutment between said first upper vertical core section and said first common upper abutment surface;

C. a third upper adhesive material positioned at the location of abutment between said second upper vertical core section and said upper end lower abutment surface;

D. a fourth upper adhesive material positioned at the location of abutment between said second upper vertical core section and said first common upper abutment surface;

E. a fifth upper adhesive material positioned at the location of abutment between said first upper internal core section and said upper end lower abutment surface; and F. a sixth upper adhesive material positioned at the location of abutment between said second upper internal core section and said first common upper abutment surface.

4. A compact high short circuit current reactor as defined in claim 3 wherein said first upper adhesive material, said second upper adhesive material, said third upper adhesive material, said fourth upper adhesive material, said fifth upper adhesive material and said sixth upper adhesive material each comprise a glue material.

5. A compact high short circuit current reactor as defined in claim 2 further including an intermediate zone adhesive means comprising:

A. a first intermediate adhesive material positioned at the location of abutment between said first intermediate vertical core section and said first common lower abutment surface;

B. a second intermediate adhesive material positioned at the location of abutment between said first intermediate vertical core section and said second common upper abutment surface;

C. a third intermediate adhesive material positioned at the location of abutment between said second intermediate vertical core section and said first common lower abutment surface;

D. a fourth intermediate adhesive material positioned at the location of abutment between said second intermediate vertical core section and said second common upper abutment surface;

E. a fifth intermediate adhesive material positioned at the location of abutment between said first intermediate internal core section and said first common lower abutment surface; and F. a sixth intermediate adhesive material positioned at the location of abutment between said second intermediate internal core section and said second common upper abutment surface.

6. A compact high short circuit current reactor as defined in claim 5 wherein said first intermediate adhesive material, said second intermediate adhesive material, said third intermediate adhesive material, said fourth intermediate adhesive material, said fifth intermediate adhesive material and said sixth intermediate adhesive material each comprise a glue material.

7. A compact high short circuit current reactor as defined in claim 2 further including an lower zone adhesive means comprising:

A. a first lower adhesive material positioned at the location of abutment between said first lower vertical core section and said second common lower abutment surface;

B. a second lower adhesive material positioned at the location of abutment between said first lower vertical core section and said lower end upper abutment surface;

C. a third lower adhesive material positioned at the location of abutment between said second lower vertical core section and said second common lower abutment surface;

D. a fourth lower adhesive material positioned at the location of abutment between said second lower vertical core section and said lower end upper abutment surface;

E. a fifth lower adhesive material positioned at the location of abutment between said first lower internal core section and said second common lower abutment surface; and F. a sixth lower adhesive material positioned at the location of abutment between said second lower internal core section and said lower end upper abutment surface.

8. A compact high short circuit current reactor as defined in claim 7 wherein said first lower adhesive material, said second lower adhesive material, said third lower adhesive material, said fourth lower adhesive material, said fifth lower adhesive material and said sixth lower adhesive material each comprise a glue material.

9. A compact high short circuit current reactor as defined in claim 2 further comprising an external clamping means for maintaining the structural configuration of the reactor comprising:

A. a horizontal clamping means including a plurality of vertically extending clamping plates positioned thereadjacent and a plurality of horizontally extending rods including first threaded ends extending generally horizontally and a plurality of horizontal nuts detachably securable to the first threaded ends of said horizontal rods for facilitating the urging of inwardly directed bias on the reactor; and B. a vertical clamping means including a plurality of horizontally extending clamping plates positioned thereadjacent and a plurality of vertically extending rods including second threaded ends extending generally vertically and a plurality of vertical nuts detachably securable to the second threaded ends of said vertical rods for facilitating the urging of inwardly directed bias on the reactor.

10. A compact high short circuit current reactor as defined in claim 2 wherein each end horizontal core section, each common horizontal core section, each vertical core section and each internal core section are formed of a plurality of stacking members stacked together to form the total size thereof wherein the thickness of each stacking member is less than one inch.

11. A compact high short circuit current reactor as defined in claim 10 wherein each stacking member is approximately 0.012 inches in thickness.

12. A compact high short circuit current reactor as defined in claim 11 wherein each stacking member is made of steel.

13. A compact high short circuit current reactor as defined in claim 2 wherein the size of said upper internal core gaps defined within said upper internal core assembly are variable and controlled by varying the vertical dimension of said first upper vertical core section and said second upper vertical core section extending between said upper end lower abutment surface of said upper end horizontal core section and said first common upper abutment surface of said first common horizontal core section to enhance operating characteristics.

14. A compact high short circuit current reactor as defined in claim 2 wherein the size of said intermediate internal core gaps defined within said intermediate internal core assembly are variable and controlled by varying the vertical dimension of said first intermediate vertical core section and said second intermediate vertical core section extending between said first common lower abutment surface of said first common horizontal core section and said second common upper abutment surface of said second common horizontal core section to enhance operating characteristics.

15. A compact high short circuit current reactor as defined in claim 2 wherein the size of said lower internal core gaps defined within said lower internal core assembly are variable and controlled by varying the vertical dimension of said first lower vertical core section and said second lower vertical core section extending between said second common lower abutment surface of said second common horizontal core section and said lower end upper abutment surface of said lower end horizontal core section to enhance operating characteristics.

16. A compact high short circuit current reactor as defined in claim 2 wherein said upper coil member is positioned immediately adjacent to said first common upper abutment surface of said first common horizontal core section and said intermediate coil member is positioned immediately adjacent to said first common lower abutment surface of said first common horizontal core section in order to introduce 120 degree flux cancellation within said first common horizontal core section.

17. A compact high short circuit current reactor as defined in claim 2 wherein said intermediate coil member is positioned immediately adjacent to said second common upper abutment surface of said second common horizontal core section and said lower coil member is positioned immediately adjacent to said second common lower abutment surface of said second common horizontal core section in order to introduce 120 degree flux cancellation within said second common horizontal core section.

18. A compact high short circuit current reactor as defined in claim 2 wherein said upper coil member, said intermediate coil member and said lower coil member are round in cross-sectional shape.

19. A compact high short circuit current reactor as defined in claim 2 wherein said upper coil member, said intermediate coil member and said lower coil member are square in cross-sectional shape.

20. A compact high short circuit current reactor comprising:

A. an upper end horizontal core section defining an upper end lower abutment surface orientated facing downwardly therefrom;

B. a first upper vertical core section in abutment with said upper end lower abutment surface of said upper end horizontal core section and extending downwardly therefrom;

C. a second upper vertical core section in abutment with said upper end lower abutment surface of said upper end horizontal core section and extending downwardly therefrom at a position spatially disposed from said first upper vertical core section;

D. a first common horizontal core section defining a first common upper abutment surface orientated facing upwardly therefrom and defining a first common lower abutment surface oriented facing downwardly therefrom, said first common upper abutment surface of said first common horizontal core section being in abutment with said first upper vertical core section and with said second upper vertical core section, said first common horizontal core section, said upper end horizontal core section, said first upper vertical core section and said second upper vertical core section together defining an upper internal core zone therebetween;

E. an upper internal core assembly positioned within said upper internal core zone extending from said upper end lower abutment surface to said first common upper abutment surface and comprising:

(1) a first upper internal core section positioned within said upper internal core zone in abutment with said upper end lower abutment surface of said upper end horizontal core section and extending downwardly therefrom at a position spatially disposed from and between said first upper vertical core section and said second upper vertical core section;

(2) a second upper internal core section positioned within said upper internal core zone in abutment with said first common upper abutment surface of said first common horizontal core section and extending upwardly therefrom at a position spatially disposed from and between said first upper vertical core section and said second upper vertical core section;

(3) at least one third upper internal core section positioned within said upper internal core zone between first upper internal core section and said second upper internal core section, each of said third upper internal core sections being spatially disposed from said first upper internal core section and spatially disposed from said second upper internal core section and spatially disposed from one another to define upper internal core gaps therebetween;

F. an upper coil member extending through said upper internal core zone and extending around said upper internal core assembly to facilitate electromagnetic interaction therewith;

G. a first intermediate vertical core section in abutment with said first common lower abutment surface of said first common horizontal core section and extending downwardly therefrom;

H. a second intermediate vertical core section in abutment with said first common lower abutment surface of said first common horizontal core section and extending downwardly therefrom at a position spatially disposed from said first intermediate vertical core section;

I. a second common horizontal core section defining a second common upper abutment surface orientated facing upwardly therefrom and defining a second common lower abutment surface oriented facing downwardly therefrom, said second common upper abutment surface of said second common horizontal core section being in abutment with said first intermediate vertical core section and with said second intermediate vertical core section, said first common horizontal core section, said second common horizontal core section, said first intermediate vertical core section and said second intermediate vertical core section together defining an intermediate internal core zone therebetween;

J. an intermediate internal core assembly positioned within said intermediate internal core zone and extending from said first common lower abutment surface to said second common upper abutment surface and comprising:

(1) a first intermediate internal core section positioned within said intermediate internal core zone in abutment with said first common lower abutment surface of said first common horizontal core section and extending downwardly therefrom at a position between said first intermediate vertical core section and said second intermediate vertical core section;

(2) a second intermediate internal core section positioned within said intermediate internal core zone in abutment with said second common upper abutment surface of said second common horizontal core section and extending upwardly therefrom at a position between said first intermediate vertical core section and said second intermediate vertical core section;

(3) at least one third intermediate internal core section positioned within said intermediate internal core zone between first intermediate internal core section and said second intermediate internal core section, each of said third intermediate internal core sections being spatially disposed from said first intermediate internal core section and spatially disposed from said second intermediate internal core section and spatially disposed from one another to define intermediate internal core gaps therebetween;

K. an intermediate coil member extending through said intermediate internal core zone and extending around said intermediate internal core assembly to facilitate electromagnetic interaction therewith, said upper coil member being positioned immediately adjacent to said first common upper abutment surface of said first common horizontal core section and said intermediate coil member being positioned immediately adjacent to said first common lower abutment surface of said first common horizontal core section in order to introduce 120 degree flux cancellation within said first common horizontal core section;

L. a first lower vertical core section in abutment with respect to said second common lower abutment surface of said second common horizontal core section and extending downwardly therefrom;

M. a second lower vertical core section in abutment with respect to said second common lower abutment surface of said second common horizontal core section and extending downwardly therefrom at a position spatially disposed from said first lower vertical core section;

N. a lower end horizontal core section defining a lower end upper abutment surface orientated facing upwardly and in abutment with said first lower vertical core section and with said second lower vertical core section, said second common horizontal core section, said first lower vertical core section, said second lower vertical core section and said lower end horizontal core section together defining a lower internal core zone therebetween;

O. a lower internal core assembly positioned within said lower internal core zone and extending from said second common lower abutment surface to said lower end upper abutment surface and comprising:

(1) a first lower internal core section positioned within said lower internal core zone in abutment with said second common lower abutment surface of said second common horizontal core section and extending downwardly therefrom at a position between said first lower vertical core section and said second lower vertical core section;

(2) a second lower internal core section positioned within said lower internal core zone in abutment with said lower end upper abutment surface of said lower end horizontal core section and extending upwardly therefrom at a position between said first lower vertical core section and said second lower vertical core section;

(3) at least one third lower internal core section positioned within said lower internal core zone between said first lower internal core section and said second lower internal core section, each of said third lower internal core sections being spatially disposed from said first lower internal core section and spatially disposed from said second lower internal core section and spatially disposed from one another to define lower internal core gaps therebetween;

P. a lower coil member extending through said lower internal core zone and extending around said lower internal core assembly to facilitate electromagnetic interaction therewith, said intermediate coil member being positioned immediately adjacent to said second common upper abutment surface of said second common horizontal core section and said lower coil member being positioned immediately adjacent to said second common lower abutment surface of said second common horizontal core section in order to introduce 120 degree flux cancellation within said second common horizontal core section;

Q. an upper zone adhesive means comprising:

(1) a first upper glue material positioned at the location of abutment between said first upper vertical core section and said upper end lower abutment surface;

(2) a second upper glue material positioned at the location of abutment between said first upper vertical core section and said first common upper abutment surface;

(3) a third upper glue material positioned at the location of abutment between said second upper vertical core section and said upper end lower abutment surface;

(4) a fourth upper glue material positioned at the location of abutment between said second upper vertical core section and said first common upper abutment surface;

(5) a fifth upper glue material positioned at the location of abutment between said first upper internal core section and said upper end lower abutment surface; and (6) a sixth upper glue material positioned at the location of abutment between said second upper internal core section and said first common upper abutment surface;

R. an intermediate zone adhesive means comprising:

(1) a first intermediate glue material positioned at the location of abutment between said first intermediate vertical core section and said first common lower abutment surface;

(2) a second intermediate glue material positioned at the location of abutment between said first intermediate vertical core section and said second common upper abutment surface;

(3) a third intermediate glue material positioned at the location of abutment between said second intermediate vertical core section and said first common lower abutment surface;

(4) a fourth intermediate glue material positioned at the location of abutment between said second intermediate vertical core section and said second common upper abutment surface;

(5) a fifth intermediate glue material positioned at the location of abutment between said first intermediate internal core section and said first common lower abutment surface; and (6) a sixth intermediate glue material positioned at the location of abutment between said second intermediate internal core section and said second common upper abutment surface;

S. a lower zone adhesive means comprising:

(1) a first lower glue material positioned at the location of abutment between said first lower vertical core section and said second common lower abutment surface;

(2) a second lower glue material positioned at the location of abutment between said first lower vertical core section and said lower end upper abutment surface;

(3) a third lower glue material positioned at the location of abutment between said second lower vertical core section and said second common lower abutment surface;

(4) a fourth lower glue material positioned at the location of abutment between said second lower vertical core section and said lower end upper abutment surface;

(5) a fifth lower glue material positioned at the location of abutment between said first lower internal core section and said second common lower abutment surface; and (6) a sixth lower glue material positioned at the location of abutment between said second lower internal core section and said lower end upper abutment surface.

* * * * *